US006578212B2

(12) United States Patent
Roudebush

(10) Patent No.: US 6,578,212 B2
(45) Date of Patent: Jun. 17, 2003

(54) CRADLE

(75) Inventor: H. Richard Roudebush, Indianapolis, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/989,150

(22) Filed: Nov. 21, 2001

(65) Prior Publication Data

US 2003/0093859 A1 May 22, 2003

(51) Int. Cl.[7] ..... A47D 9/00
(52) U.S. Cl. ..... 5/108; 5/106; 5/101
(58) Field of Search ..... 5/93.1, 101, 103, 5/105, 106, 107, 108, 124, 607

(56) References Cited

U.S. PATENT DOCUMENTS

| | | | | |
|---|---|---|---|---|
| 204,944 A | | 6/1878 | Bernhard | |
| 237,820 A | | 2/1881 | Clark | |
| 335,203 A | | 2/1886 | Kenna | |
| 469,131 A | | 2/1892 | Freid | |
| 522,783 A | | 7/1894 | Dewey | |
| 594,015 A | | 11/1897 | Homer | |
| 597,168 A | | 1/1898 | Millard | |
| 600,116 A | | 3/1898 | Benning | |
| 682,284 A | | 9/1901 | Schroder | |
| 962,587 A | | 6/1910 | Raettig | |
| 1,526,802 A | | 2/1925 | Matthews | |
| 1,574,226 A | * | 2/1926 | Ackerman | 5/101 |
| 1,715,600 A | | 6/1929 | Hoover | |
| 1,990,357 A | * | 2/1935 | Ward | 5/607 |
| 2,793,374 A | | 5/1957 | Doud | |
| 4,114,209 A | | 9/1978 | Sandlin | |
| 4,175,550 A | * | 11/1979 | Leininger et al. | 601/5 |
| 4,251,890 A | | 2/1981 | Dainty | |
| 4,432,353 A | * | 2/1984 | Vrzalik | 601/5 |
| 4,996,732 A | | 3/1991 | Chang | |
| 5,048,135 A | | 9/1991 | Chen | |
| 5,307,531 A | | 5/1994 | Kao | |
| 6,257,659 B1 | | 7/2001 | Wilkins et al. | |

* cited by examiner

*Primary Examiner*—Michael F. Trettel
(74) *Attorney, Agent, or Firm*—Barnes & Thornburg

(57) ABSTRACT

A cradle is provided having a connector coupling a base frame to a bed frame. The connector restricts movement of the bed frame relative to the base frame. Additionally, a lock is coupled to the connector for fixing movement of the bed frame relative to the base frame.

26 Claims, 5 Drawing Sheets

CRADLE

BACKGROUND AND SUMMARY

The present disclosure relates to cradles, and in particular to rocking cradles. More particularly, the present disclosure relates to rocking cradles having a locking mechanism and/or a swing controller.

Cradles can be used by a caregiver to provide an elevated but safe resting place for a child. Rocking cradles allow for rocking movement of the bed frame with relation to the base frame, so that the child may be rocked to sleep. A typical cradle swings about a pivot axis disposed above the infant. This suspension provides a movement conducive to sleeping.

According to the present disclosure, a cradle comprises a base frame, and a bed frame pivotably coupled to the base frame for movement relative to the base frame about a pivot axis. The cradle includes a connector configured to pivotably couple the bed frame to the base frame for pivotable or rocking movement about the axis.

A lock apparatus may be provided, the lock apparatus comprising first and second lock members. In one embodiment, the second lock member is formed from a portion of the connector. According to the disclosure, one of the lock and the connector has a tab and the other of the lock and the connector has a slot configured to receive the tab, thereby locking the bed frame against movement relative to the base frame.

In illustrative embodiments, the lock apparatus is coupled to the base frame. The first lock member has a locked position and an unlocked position. The first lock member is movable in a direction substantially parallel to the pivot axis when it is moved between the locked and the unlocked position.

In illustrative embodiments, the connector is further configured to restrict pivoting of the bed frame relative to the base frame to within a predetermined angle. The connector illustratively has a first portion coupled to the base frame and a second portion coupled to the bed frame. The first portion and second portion are coaxial.

Additional features of the present disclosure will become apparent to those skilled in the art upon consideration of the following detailed description of illustrative embodiments exemplifying the best mode of carrying out the present disclosure as presently perceived.

BRIEF DESCRIPTION OF THE DRAWINGS

The detailed description particularly refers to the accompanying figures in which.

DETAILED DESCRIPTION OF THE DRAWINGS

Figure 1:
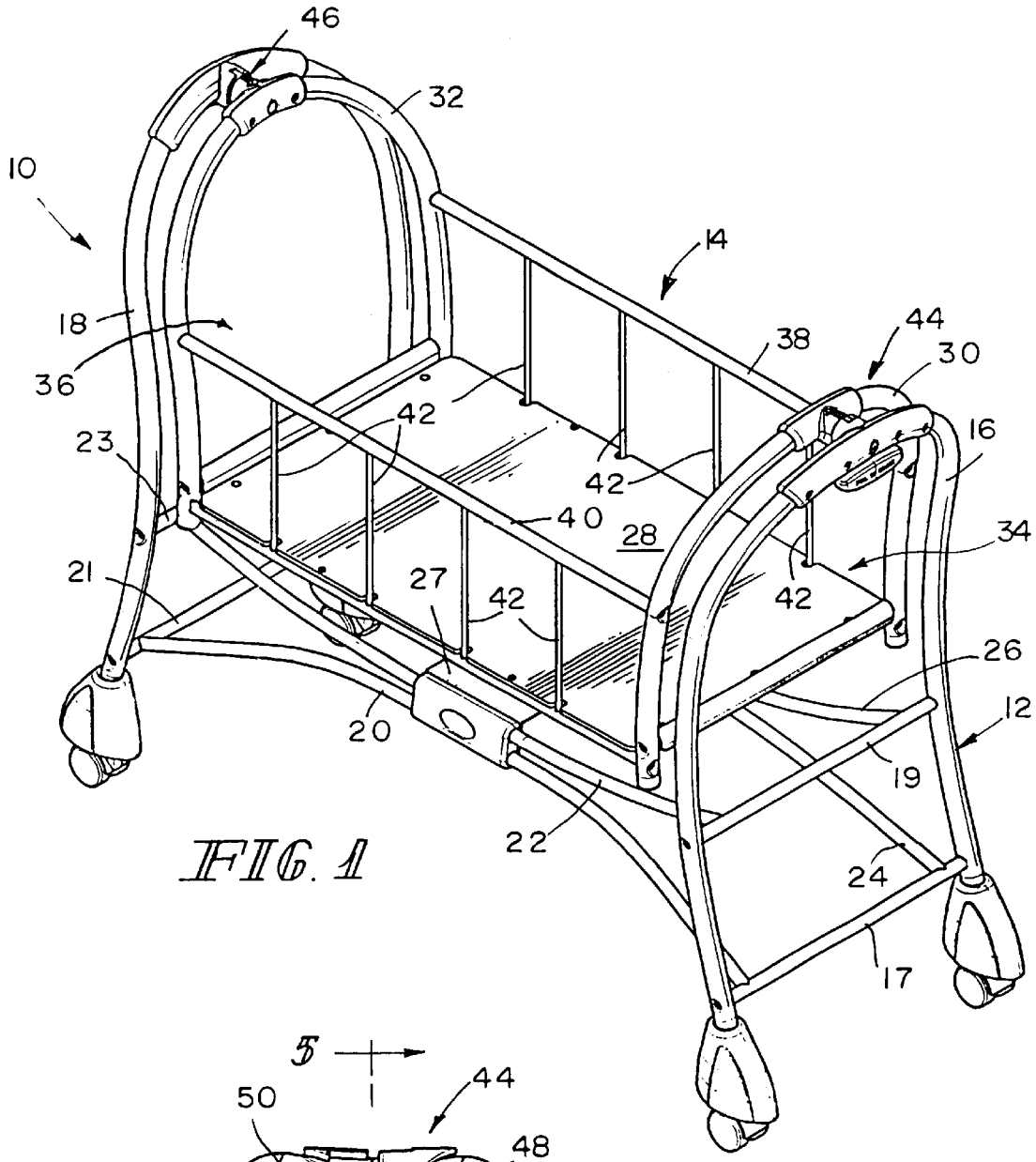
FIG. 1 is a perspective view of a juvenile cradle in accordance with the present invention showing the bed frame pivotably coupled to the base frame, and showing a lock having a handle for locking the bed frame in a fixed position relative to the base frame.

A cradle 10, shown without fabric coverings in FIG. 1, comprises a base frame 12 and a bed frame 14 coupled for movement relative to the base frame 12. Base frame 12 includes arcuate end members 16, 18 and cross bars 17, 19, 21, 23. Cross bars 17, 19, 21, 23 are connected by lower support bars 20, 24 and upper support bars 22, 26, whereby arcuate end members 16, 18 are fixed in spaced relation to each other. Lower and upper support bars 20, 22, 24, 26 are further connected by lateral support beam 27.

Bed frame 14 comprises a bottom web 28 formed in the shape of a rectangle, and arcuate bed end members 30, 32 coupled to opposite ends 34, 36 of the bottom web 28. Bed frame 14 further comprises railings 38, 40 and vertical bars 42. Although base frame 12 and bed frame 14 have been described in the foregoing manner, it should be understood that other embodiments for base frame 12 and bed frame 14 are within the scope of the disclosure.

Figure 2:
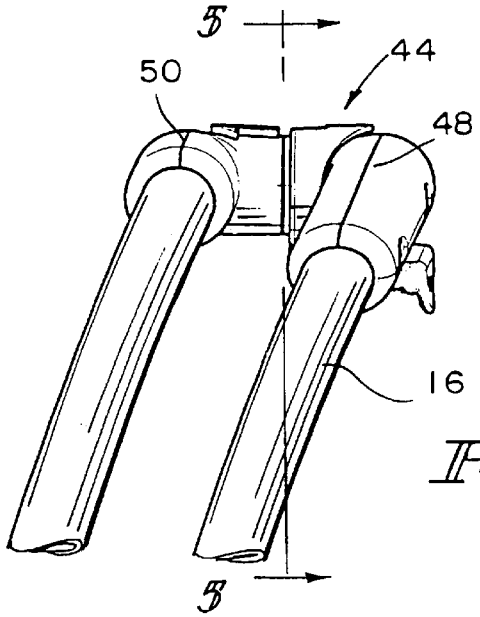
FIG. 2 is an enlarged side view of the lock of FIG. 1, showing the handle positioned under a base frame member and showing a connector coupling the base frame member to a bed frame member.

Bed frame 14 is pivotably connected to base frame 12 by connectors 44, 46, as shown in FIG. 1. At least one connector 44 is constructed according to the following description, and is further depicted in FIGS. 2–12. Connector 44 includes a base portion 48 configured to attach to arcuate end member 16 of base frame 12 and a bed portion 50 configured to attach to arcuate bed end member 30, as shown in FIG. 2.

Figures 3, 4:
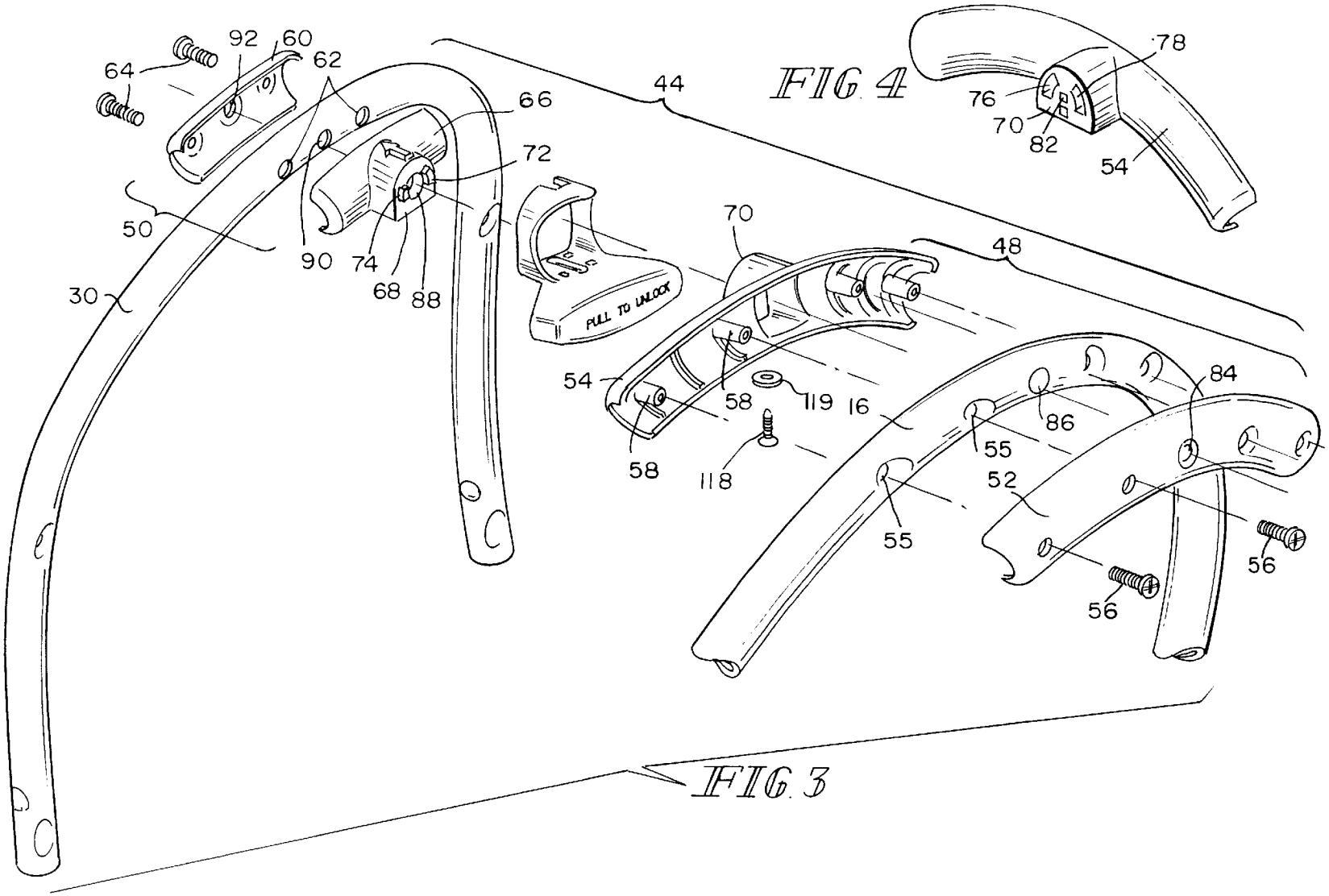
FIG. 3 is an exploded perspective assembly view of the base frame member, the bed frame member, the connector, and the lock, showing the lock formed to include a sleeve for slidably fitting over a first portion and a second portion of the connector.
FIG. 4 is a perspective view of a first, slotted portion of the connector, the slotted portion being configured to mount on the base frame member, and further configured to cooperate with a second, tabbed portion of the connector, shown in FIG. 3.

Base portion 48 can be seen in assembly view in FIG. 3, and illustratively comprises outer member 52 and connecting member 54. Illustratively, outer member 52 and connecting member 54 are fastened about arcuate end member 16 with fasteners 56. Arcuate end member 16 is formed to include apertures 55 through which fasteners 56 pass to engage fastener receivers 58. A front perspective view of connecting member 54 can be seen in FIG. 4.

Bed portion 50 can also be seen in assembly view in FIG. 3, and illustratively comprises an inner member 60 and a second connecting member 62. Fasteners 64 connect inner member 60 to second connecting member 62 through apertures 66 formed in arcuate bed end member 30. Illustratively, second connecting member 62 includes a contact face 68 configured to mate with contact face 70 (best viewed in FIG. 4) of connecting member 54. As can be seen in FIGS. 3 and 4, tabs 72, 74 extend from contact face 68 of second connecting member 62 toward connecting member 54, and are configured to mate with arcuate slots 76, 78, respectively, formed in contact face 70 of connecting member 54.

Figure 5:
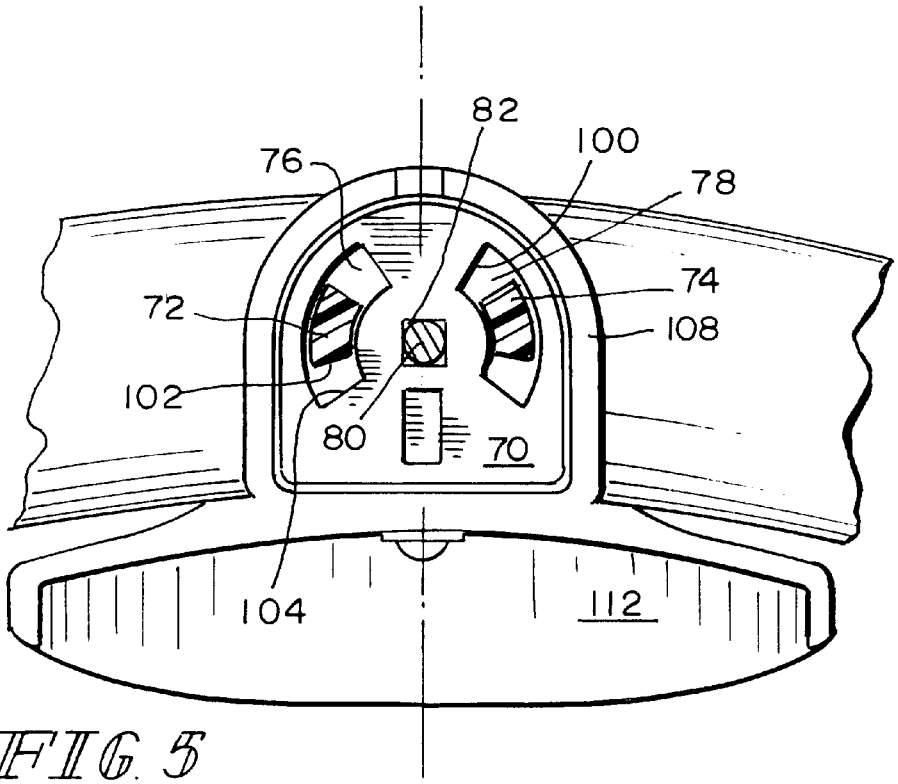
FIG. 5 is a sectional view taken along the line 5—5 of FIG. 2, showing a view of the slotted portion of the connector and showing the cooperating tabs of the tabbed portion of the connector inserted in the slots of the slotted portion.

FIG. 5 shows a cross-sectional view of connector 44 after it has been assembled and tabs 72, 74 mated with arcuate slots 76, 78. Also, axial rod 80 can be seen inserted in aperture 82, thereby forming an axis about which bed portion 50 can pivot relative to base portion 48. Although not shown in FIG. 3, it should be understood that axial rod 80 also extends through apertures 84, 86, 88, 90, and 92 to form the axis of rotation between base frame 12 and bed frame 14. A view of axial rod 80 can be seen in sectional views of FIGS. 11 and 12. Illustratively, axial rod 80 is a screw 79 and a screw receiver 81.

Figure 6:
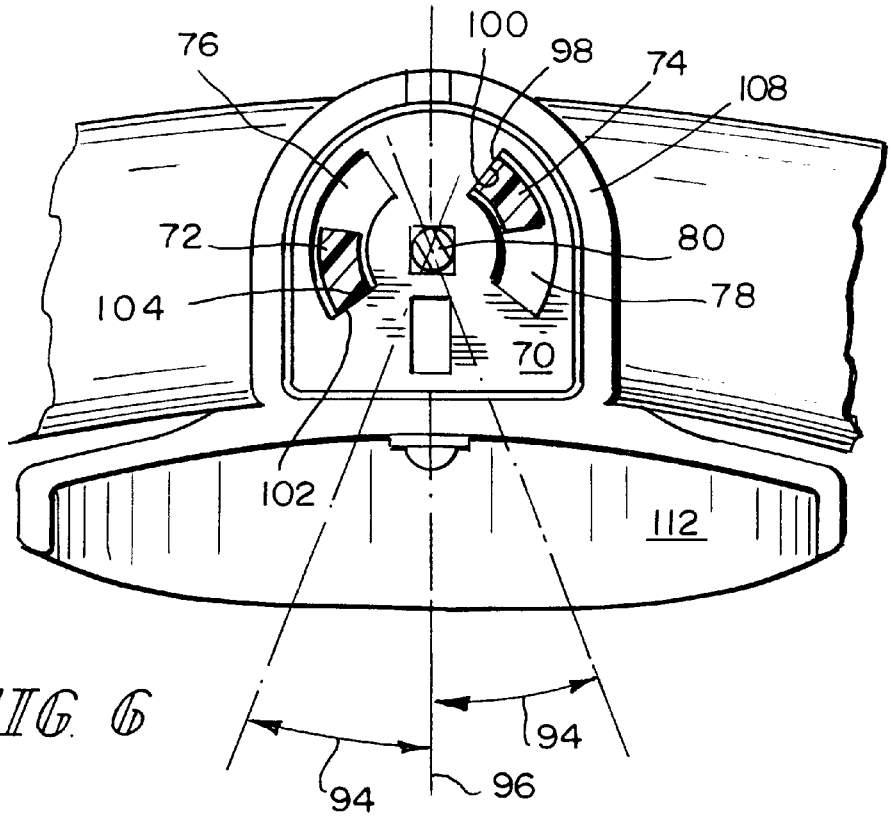
FIG. 6 is a sectional view similar to that of FIG. 5, showing the tabs rotated relative to the slots, indicative of the rotation of the bed frame relative to the base frame, and also showing the tabs abutting web portions on the slotted portion of the connector, the web portions cooperating with the tabs to restrict rotation of the bed frame to within a predetermined degree of rotation relative to the base frame.

Tabs 72, 74 cooperate with arcuate slots 76, 78 to restrict rotation of bed frame 14 relative to base frame 12 in substantially the following manner. When bed frame 14 is in its resting position relative to base frame 12, as can be seen in FIG. 1, tabs 72, 74 are substantially centered in arcuate slots 76, 78, respectively, as shown in FIG. 5. From such a position, bed frame 14 is capable of being rotated to an angle 94 in either direction from-the resting position (indicated as vertical line 96), as can be seen in FIG. 6.

Rotation of bed frame 14 relative to base frame 12 is limited by contact of tabs 72, 74 with the end walls of slots 76, 78. For example, when bed frame 14 is rotated or swung relative to base frame 12 to an angle 94, top surface 98 of tab 74 contacts end wall 100 of slot 78, as shown in FIG. 6. Simultaneously and similarly, bottom surface 102 of tab 72 contacts end wall 104. The contact between tabs 72, 74 and end walls 100, 104 prevents further rotation of bed frame 14 relative to base frame 12 so that a juvenile in the cradle bed can be rocked to within a predetermined safe range.

In the illustrated embodiment, cradle 10 further includes a lock apparatus 106 for locking bed frame 14 in a fixed position relative to base frame 12. Lock apparatus 106 comprises a first lock member 108 carried by base portion 48, and a second lock member 110 coupled to the bed portion 50 of connector 44. First lock member 108 is movable relative to second lock member 110, and is configured to engage second lock member 110 thereby fixing bed frame 14 in a fixed position relative to base frame 12, as shown in FIGS. 7–12. It should be understood that cradle 10 could be alternately configured to have first lock member 108 carried by bed portion 50 and second lock member 110 coupled to base portion 48.

Figure 8:
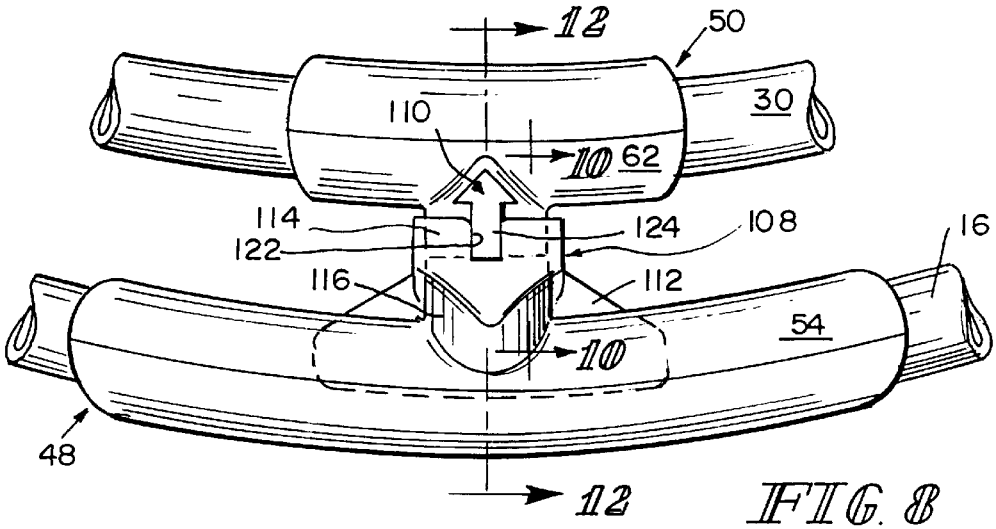
FIG. 8 is a fragmentary top view similar to that of FIG. 7, showing engagement of the lock with the tab formed in the connector to lock the bed frame relative to the base frame.

First lock member 108 illustratively comprises a handle 112 coupled to an annular ring or substantially cylindrical member 114. As shown in FIGS. 3 and 8, first lock member is configured to sleeve over substantially cylindrical protrusion 116, which extends from connecting member 54. A fastener 118 is inserted through washer 119 and slot 120 formed in cylindrical member 114, and fastener 118 is fastened to cylindrical protrusion 116 such that first lock member 108 is axially movable along cylindrical protrusion 116 between a locked position, shown in FIG. 12, and an unlocked position, shown in FIG. 11.

Figure 10:
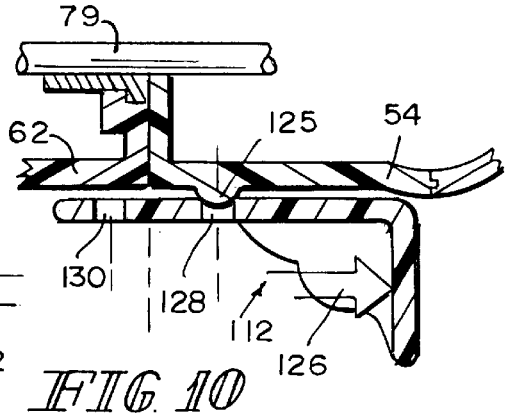
FIG. 10 is a sectional view similar to that of FIG. 9, showing the handle of the lock in the engaged position, and showing a second aperture formed in the handle for contacting the projection thereby holding the handle in the engaged position.
Figure 12:
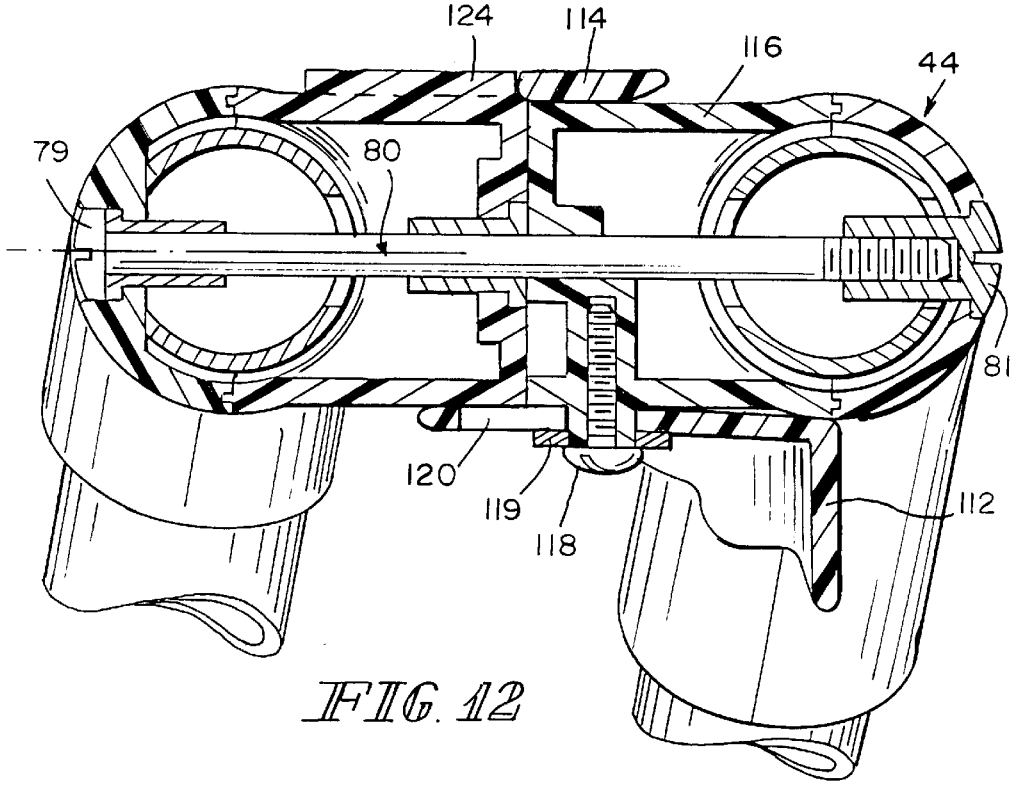
FIG. 12 is a sectional view similar to that of FIG. 11, showing the lock moved into the engaged position, where the sleeve is positioned such that it encompasses a portion of the tab, thereby locking the first portion of the connector in place relative to the second portion.

When first lock member 108 is in the locked position, as shown in FIGS. 8, 10, and 12, notch 122 formed in first lock member 108 mates with second lock member 110, which illustratively is an arrow-shaped tab 124. When mated, first and second lock members 108, 110 are prevented from rotating relative to each other because arrow-shaped tab 124 is fixed against rotational movement in notch 122. The mating of first and second lock members 108, 110 also resultingly prevents the rotation of bed frame 14 relative to base frame 12. First lock member 108 can be moved into the locked position when bed frame 14 is in the resting position shown in FIG. 1.

First lock member 108 is held in the locked position by the cooperation of ridge 125 with aperture 128, as shown in FIG. 10. First lock member 108 is moved to the unlocked position shown in FIGS. 7, 9, and 11 by application of pressure on handle 112 in the direction 126 shown in FIG. 10. In the unlocked position shown in FIG. 9, first lock member 108 is held in the unlocked position by the cooperation of ridge 125 with aperture 130 until force is applied in the direction 132.

Figure 7:
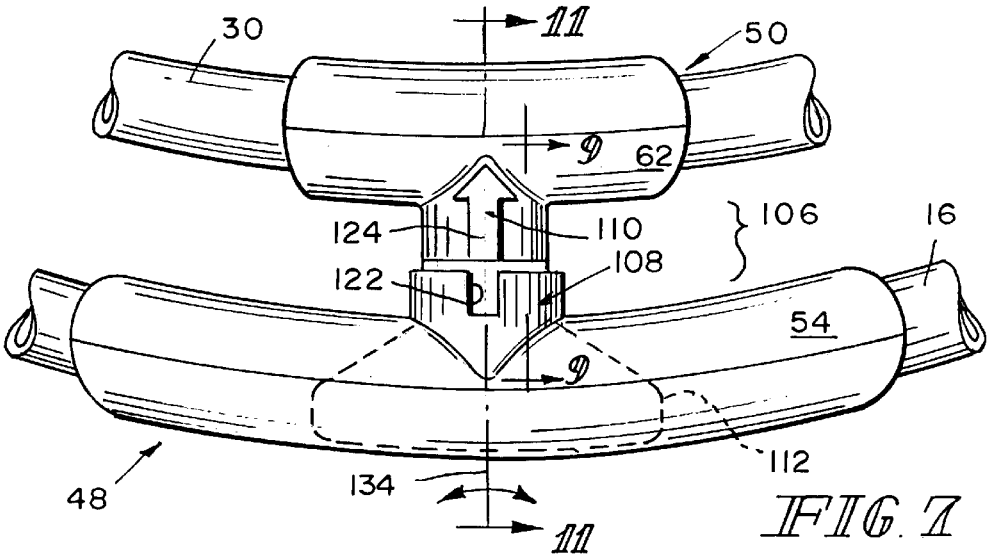
FIG. 7 is a fragmentary top view of the lock in the disengaged position relative to the connector, showing a slot formed in the lock, the slot being configured to engage a tab (shown shaped as an arrow) formed in the second portion of the connector.
Figure 9:
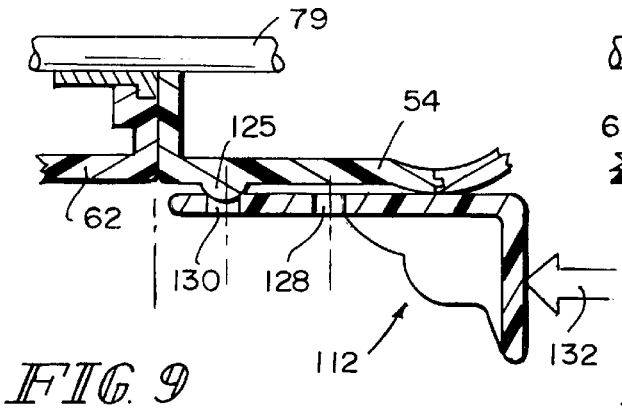
FIG. 9 is a sectional view taken along the line 9—9 of FIG. 7, showing the handle of the lock in the disengaged position, and showing an aperture formed in the handle for engaging a projection formed in the bottom of the slotted portion of the connector thereby holding the handle in the disengaged position.
Figure 11:
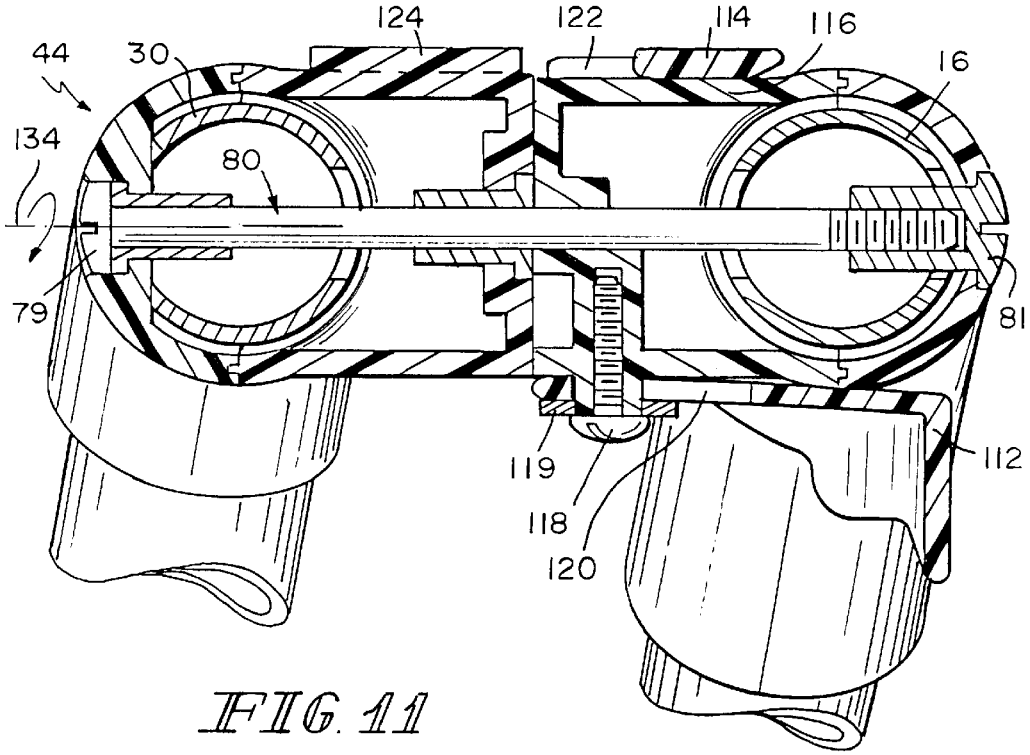
FIG. 11 is a sectional view taken along the line 11—11 of FIG. 7, showing the sleeve of the lock substantially encompassing the first portion of the connector in the disengaged position, and showing the tab protruding from the top of the second portion of the connector.

In the unlocked position shown in FIGS. 7, 9, and 11, first lock member 108 is disengaged from second lock member 110 thereby permitting rotation of bed portion 50 relative to base portion 48 about axis 134, shown in FIGS. 7 and 11.

The disclosed embodiment, as shown in FIG. 1, can be described to include a base frame 12 having longitudinally spaced, upwardly extending end members 16, 18. Each end member 16, 18 has a top portion defining a central, longitudinally extending pivot axis 134.

A bed frame 14 is shown to also have longitudinally spaced, upwardly extending end members 30, 32 disposed between the base frame end members 16, 18. Bed frame end members 30, 32 each have a top portion longitudinally aligned with the top portion of one of the base frame end members 16, 18.

A first connector 44 and a second connector 46 are configured to pivotably couple the bed frame 14 to the base frame 12 along the longitudinal axis. The first connector 44 couples the bed and base end members 16, 30 at one end of the cradle and the second connector 46 couples the bed and base end members 18, 32 at the other end of the cradle. Furthermore, a lock is configured to engage the first connector 44 to prevent pivotable movement of the bed frame 14 relative to the base frame 12.

What is claimed is:

1. A cradle comprising a base frame, a bed frame pivotably coupled to the base frame for movement relative to the base frame about a pivot axis, and a lock apparatus coupled to the base frame, the lock apparatus comprising a first lock member having a locked position and an unlocked position, the first lock member being movable in a direction substantially along the pivot axis when it is moved between the locked and the unlocked position.

2. The cradle of claim 1, wherein the first lock member has a handle.

3. The cradle of claim 1, wherein the lock apparatus comprises a second lock member coupled to the bed frame for pivotable movement with the bed frame, the first lock member being configured to engage the second lock member.

4. The cradle of claim 3, wherein the first lock member engages the second lock member when the first lock member is moved to the locked position.

5. A cradle comprising a base frame, a bed frame pivotably coupled to the base frame for movement relative to the base frame about a pivot axis, a lock apparatus coupled to the base frame, the lock apparatus comprising a first lock member having a locked position and an unlocked position, the first lock member being movable in a direction substantially parallel to the pivot axis when it is moved between the locked and the unlocked position, and wherein the first lock member comprises an annular ring mounted substantially concentrically about the pivot axis.

6. A cradle comprising a base frame, a bed frame pivotably coupled to the base frame for movement relative to the base frame about a pivot axis, a lock apparatus coupled to the base frame, the lock apparatus comprising a first lock member having a locked position and an unlocked position, the first lock member being movable in a direction substantially parallel to the pivot axis when it is moved between the locked and the unlocked position, wherein the lock apparatus comprises a second lock member coupled to the bed frame for pivotable movement with the bed frame, the first lock member being configured to engage the second lock member, and wherein the first lock member includes a notch and the second lock member includes a tab, the notch being configured to receive the tab and thereby lock the first lock member in a fixed position relative to the second lock member.

7. The cradle of claim 6, wherein the bed frame has a resting position relative to the base frame, and the notch is configured to engage the tab only when the bed frame is in the resting position.

8. A cradle comprising a base frame, a bed frame, a connector configured to pivotably couple the bed frame to the base frame, and a lock configured to engage the connector, wherein one of the lock and the connector has a tab and the other of the lock and the connector has a slot configured to receive the tab, thereby locking the bed frame against movement relative to the base frame.

9. The cradle of claim 8, wherein the connector is substantially cylindrical and has an axis.

10. The cradle of claim 9, wherein the lock is configured to move between a locked position and an unlocked position in a direction substantially parallel to the axis.

11. The cradle of claim 8, wherein the lock is a sleeve configured to slidably move along the connector.

12. The cradle of claim 8, wherein the lock includes a handle.

13. The cradle of claim 8, wherein the connector restricts rotation of the bed frame relative to the base frame to within a predetermined angle of rotation.

14. A cradle comprising a base frame, a bed frame, and a connector configured to pivotably couple the bed frame to the base frame about a pivot axis, wherein the connector includes a lock member moveable substantially along the pivot axis to restrict pivoting of the bed frame relative to the base frame to within a predetermined angle.

15. The cradle of claim 14, wherein the connector has a first portion coupled to the base frame and a second portion coupled to the bed frame.

16. The cradle of claim 15, wherein the first portion and second portion are coaxial.

17. A cradle comprising a base frame, a bed frame, a connector configured to pivotably couple the bed frame to the base frame, wherein the connector is configured to restrict pivoting of the bed frame relative to the base frame to within a predetermined angle, wherein the connector has a first portion coupled to the base frame and a second portion coupled to the bed frame, and wherein one of the first portion and the second portion includes a slot and the other of the first portion and the second portion includes an axially extending tab configured to mate with the slot.

18. The cradle of claim 17, wherein the slot is arcuately formed about a central axis.

19. The cradle of claim 17, wherein the axially extending tab moves relative to the slot when the bed frame is rotated relative to the base frame.

20. A cradle comprising a base frame having longitudinally spaced, upwardly extending end members, the end members each having a top portion defining a central, longitudinally extending pivot axis, a bed frame having longitudinally spaced, upwardly extending end members disposed between the base frame end members, the bed frame end members each having a top portion longitudinally aligned with the top portion of one of the base frame end members, a first connector and a second connector configured to pivotably couple the bed frame to the base frame along the pivot axis, the first connector coupling the bed and base end members at one end of the cradle and the second connector coupling the bed and base end members at the other end of the cradle, and a lock configured to move in a direction substantially along the pivot axis to engage the first connector to prevent pivotable movement of the bed frame relative to the base frame.

21. The cradle of claim 20, wherein the lock is configured to move between a locked position and an unlocked position in a direction substantially parallel to the longitudinal axis.

22. The cradle of claim 20, wherein the lock includes a handle.

23. A cradle comprising a base frame having longitudinally spaced, upwardly extending end members, the end members each having a top portion defining a central, longitudinally extending pivot axis, a bed frame having longitudinally spaced, upwardly extending end members disposed between the base frame end members, the bed frame end members each having a top portion longitudinally aligned with the top portion of one of the base frame end members, a first connector and a second connector configured to pivotably couple the bed frame to the base frame along the longitudinal axis, the first connector coupling the bed and base end members at one end of the cradle and the second connector coupling the bed and base end members at the other end of the cradle, a lock configured to engage the first connector to prevent pivotable movement of the bed frame relative to the base frame, and wherein the first connector has a tab and the lock has a slot configured to receive the tab.

24. A cradle comprising a base frame having longitudinally spaced, upwardly extending end members, the end members each having a top portion defining a central, longitudinally extending pivot axis, a bed frame having longitudinally spaced, upwardly extending end members disposed between the base frame end members, the bed frame end members each having a top portion longitudinally aligned with the top portion of one of the base frame end members, a first connector and a second connector configured to pivotably couple the bed frame to the base frame along the longitudinal axis, the first connector coupling the bed and base end members at one end of the cradle and the second connector coupling the bed and base end members at the other end of the cradle, a lock configured to engage the first connector to prevent pivotable movement of the bed frame relative to the base frame, and wherein the first connector is substantially cylindrical.

25. A cradle comprising a base frame having longitudinally spaced, upwardly extending end members, the end members each having a top portion defining a central, longitudinally extending pivot axis, a bed frame having longitudinally spaced, upwardly extending end members disposed between the base frame end members, the bed frame end members each having a top portion longitudinally aligned with the top portion of one of the base frame end members, a first connector and a second connector configured to pivotably couple the bed frame to the base frame along the longitudinal axis, the first connector coupling the bed and base end members at one end of the cradle and the second connector coupling the bed and base end members at the other end of the cradle, a lock configured to engage the first connector to prevent pivotable movement of the bed frame relative to the base frame, and wherein the lock is a sleeve configured to slidably move along the first connector.

26. A cradle comprising a base frame having longitudinally spaced, upwardly extending end members, the end members each having a top portion defining a central, longitudinally extending pivot axis, a bed frame having longitudinally spaced, upwardly extending end members disposed between the base frame end members, the bed frame end members each having a top portion longitudinally aligned with the top portion of one of the base frame end members, a first connector and a second connector configured to pivotably couple the bed frame to the base frame along the longitudinal axis, the first connector coupling the bed and base end members at one end of the cradle and the second connector coupling the bed and base end members at the other end of the cradle, a lock configured to engage the first connector to prevent pivotable movement of the bed frame relative to the base frame, and wherein the first connector restricts rotation of the bed frame relative to the base frame to within a predetermined angle of rotation.

* * * * *